US005107653A

United States Patent [19]

Lewis

[11] Patent Number: 5,107,653

[45] Date of Patent: Apr. 28, 1992

[54] HOLLOW STACKABLE BUILDING BLOCK

[76] Inventor: John F. Lewis, P.O. Box 363, Hudson Heights, Quebec, Canada, J0P 1J0

[21] Appl. No.: 613,103

[22] Filed: Nov. 14, 1990

[51] Int. Cl.[5] ..... E04C 1/08

[52] U.S. Cl. ..... 52/593; 52/574

[58] Field of Search ..... 52/593, 574, 608

[56] References Cited

U.S. PATENT DOCUMENTS 4,766,711 8/1988 Bermingham et al. ..... 52/574

4,896,456 1/1990 Grant ..... 47/83

FOREIGN PATENT DOCUMENTS 2140053 11/1984 United Kingdom .

*Primary Examiner*—Richard E. Chilcot, Jr.

*Attorney, Agent, or Firm*—Andrus, Sceales, Starke & Sawall

[57] ABSTRACT

A lightweight, hollow building block is disclosed. The building block preferably has a rectangular base and an open pentagonal top. Two adjacent sides of the block form right angles with the base and the top. The three remaining adjacent sides are inclined outwardly from the base at an angle which permits the blocks to be stacked one inside another. When four such blocks are arranged in a double-wide and double-long pattern, they form a rectangular, vertical sided building unit. A building is constructed from the blocks by laying a course at the time and preferably filling the open, upturned blocks in each course with some locally available filler material to lend weight and stability to the structure.

13 Claims, 7 Drawing Sheets

FIG.9
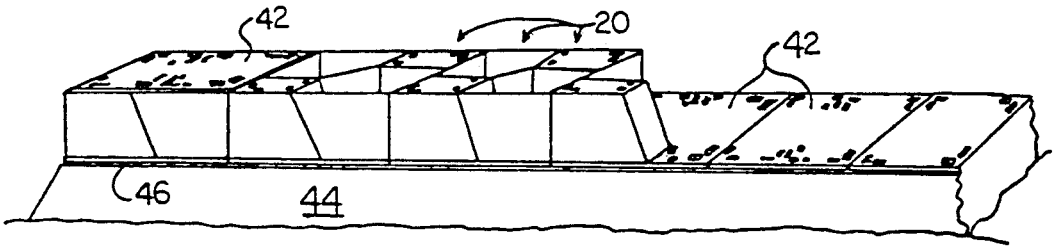
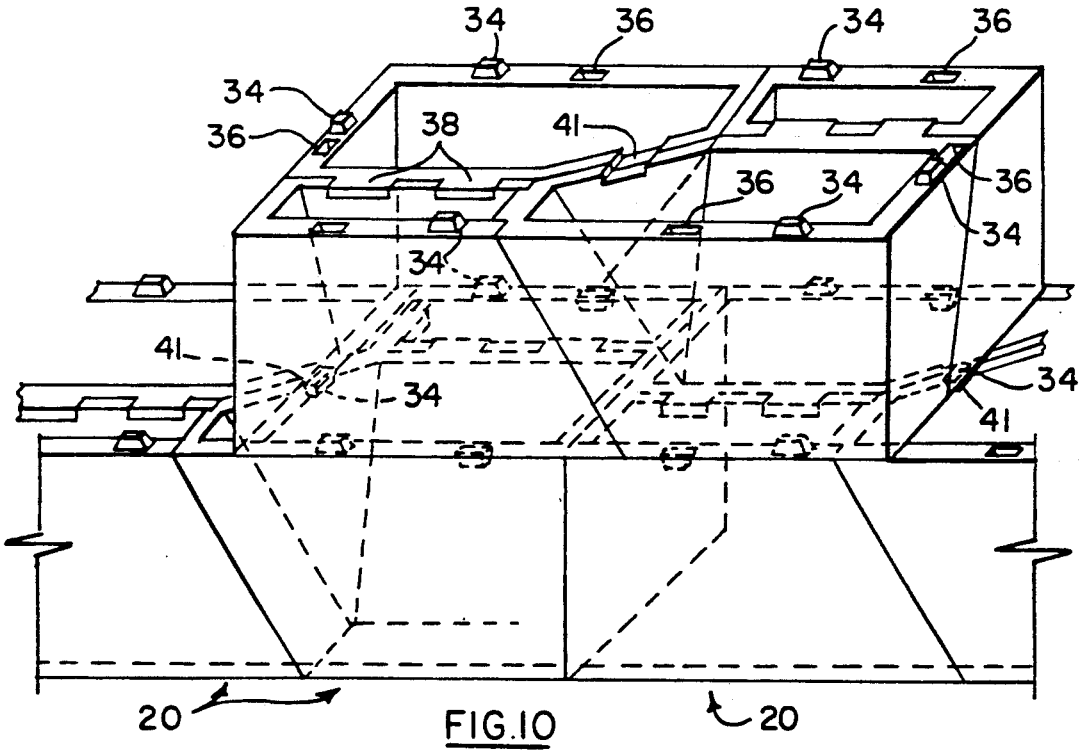
FIG.10

HOLLOW STACKABLE BUILDING BLOCK

The present invention relates to building construction units and, in particular, to a reusable stackable, hollow building block.

BACKGROUND OF THE INVENTION

Building blocks of various shapes, sizes and materials have been in common use for thousands of years. Building blocks are traditionally made from rigid materials such as stone, burnt clay, concrete or wood. Although blocks made from these materials are well adapted to use in construction, they have certain disadvantages. First, building blocks made from stone, burnt clay, concrete and similar materials are heavy and difficult to handle and transport to a construction site. Especially in third world countries where transportation is scarce and often unreliable, the transport of building materials can be a major consideration. Second, the assembly of traditional building materials generally requires a certain level of skill. Third, for reasons of economy and/or their inherent properties most building materials are either impractical or impossible to reuse.

Alternate building systems which provide building blocks that may be laid by relatively unskilled labour have been proposed. One notable example of such a system is described in British patent application 2,140,053 which discloses a number of different shapes for interlocking blocks. The blocks described are preferably molded from cementious or burnt clay materials. Although this system appears to eliminate some of the disadvantages of traditional building blocks, it does not address the problem of transporting heavy, and bulky building blocks to construction sites or the problems inherent in handling such materials.

Transportation of building materials can be a major consideration in certain situations, especially when normal transportation routes are disrupted or destroyed by a natural disaster such as an earthquake, typhoon or the like. Such disruptions can affect transportation routes for months or years. A need has therefore been recognized for a lightweight easily transported building block which can be readily assembled into either a temporary or a permanent shelter by relatively unskilled labor with a minimum of instruction.

It is an object of the present invention to provide a lightweight hollow building block which may be stacked, one inside the other, for efficient transportation and storage.

It is a further object of the present invention to provide a building block which is readily adapted to the erection of a building structure by relatively unskilled labour.

It is yet a further object of the present invention to provide a hollow building block which may be used to erect a building structure and repeatedly reused for the same purpose.

SUMMARY OF THE INVENTION

In order to provide a "stacking" hollow building block which may be nested inside another similar block, in the way dixie cups may be stacked, at least two adjacent sides of the block must be inclined outwardly with respect to the base of the block. Experimentation has proven that a variety of shapes may be used to achieve a hollow stackable block set which may be used to construct vertical parallel-sided wall structures.

In order to minimize the number of differently shaped or sized blocks required to construct all the walls of a simple building, however, it appears that one particular shape is superior for constructing vertical parallel-sided walls structures. The shape which has proven most efficacious is a hollow block having a rectangular base and an open pentagonal top. This particular shape permits the construction of wall structures with a maximum of two different blocks, i.e. full block and a half block units.

A first embodiment of a building block in accordance with the present invention is a block which includes a rectangular base, an end wall and one side wall which ar perpendicular to the base, an end wall and a side wall which are outwardly inclined so that they preferably form an angle of 15° to 60° with the base, and a triangular side wall which is intermediate the adjacent ends of the inclined end wall and the inclined side wall. Four such building blocks may be placed together in a side-by-side, two blocks wide, and end-to-end, two blocks long, arrangement so that they form a vertical sided rectangular building unit. An interlocking cover plate which interlocks the four blocks into a stable rectangular building unit is also provided. The interlocking cover plates (hereinafter referred to simply as "cover plates") are likewise stackable for transport or storage. In accordance with a preferred version of the first embodiment of the invention, the outer surface of the base of each building block is provided with short tapered lugs and shallow sockets which cooperate with complementary lugs and sockets on the cover plates to provide an interlock between the blocks of each unit.

In another embodiment of the invention, the side walls of each block are somewhat thicker and provided with strategically positioned projecting lugs and complementary sockets so that the blocks interlock directly without cover plates. Another version of this embodiment is constructed without a bottom wall.

Either embodiment may also be provided with integral hooks along the top edge of the inclined side and end walls and complementary slots for receiving the hooks situated along the bottom edges of those walls.

Either embodiment may further include reinforcing ribs or corrugations on the inside of each block. Reinforcement ribs also help prevent stacked blocks from sticking together and thereby facilitate handling of the blocks.

Walls erected with blocks in accordance with the invention are preferably filled with some locally available filler material to lend weight and stability to the wall. The filler is poured into the open upturned blocks in each wall course.

In general terms, a hollow stackable building block in accordance with the invention for the assembly of vertical parallel sided wall structures, comprises:

a polygonal block structure having side walls with parallel spaced-apart top and bottom edges which respectively define the perimeters of a base plane and a top plane of the block;

at least two of the side walls being inclined at an acute angle with respect to the base plane of the block; and the top plane of the block is not closed by a top wall so that two or more said blocks may be stacked one inside the other for efficient transport and storage.

BRIEF DESCRIPTION OF THE DRAWINGS

A preferred embodiment of the invention will now be described by way of example only and with reference to the following drawings wherein:

FIG. 9 is a perspective view of a first wall course constructed from building blocks shown in FIGS. 1–4 and the cover plates shown in FIG. 5;

FIG. 10 is a schematic diagram of a portion of a wall constructed with the blocks shown in FIGS. 6 and 7;

DETAILED DESCRIPTION OF THE PREFERRED EMBODIMENTS

Figure 2:
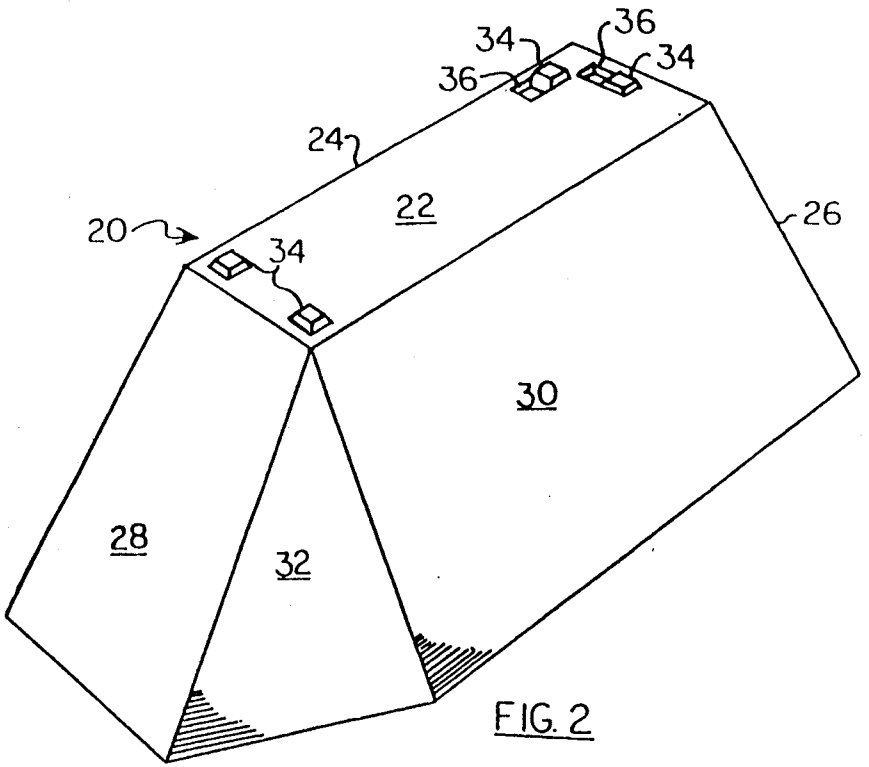
FIG. 2 is a perspective view of the building block shown in bottom plan view in FIG. 1.
Figure 1:
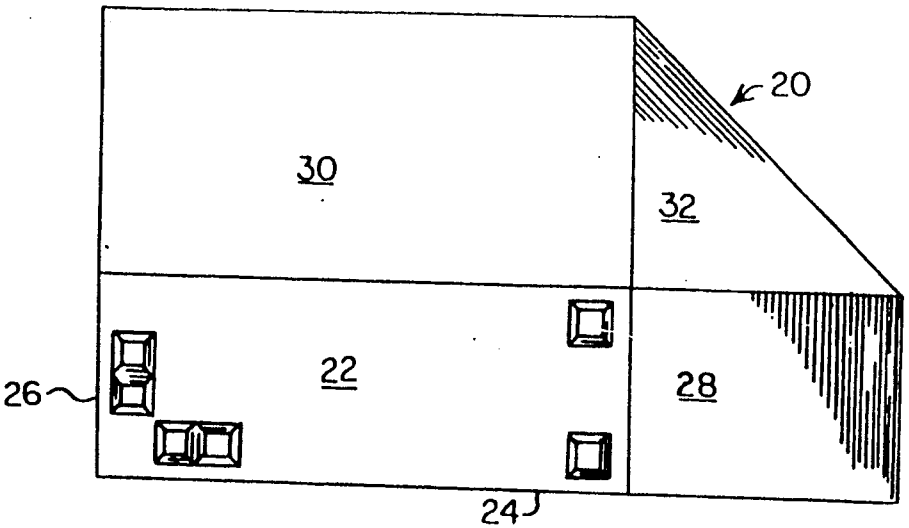
FIG. 1 is a bottom plan view of a first embodiment of a block in accordance with the invention.

As shown in FIGS. 1 and 2, a building block in accordance with the invention, generally indicated by reference 20, includes a rectangular base 22, a vertical side wall 24, a vertical end wall 26, one outwardly inclined end wall 28, one outwardly inclined side wall 30 and an interconnecting triangular side wall 32 which inclines at the same angle as side walls 28 and 30. The vertical side wall and vertical end walls 24 and 26 respectively permit the construction of vertical, parallel sided wall structures. The sloping side and end walls 28, 30 and 32, on the other hand, permit the stacking of the building blocks for efficient storage and transport. Blocks in accordance with the invention must be manufactured to relatively exacting tolerances. The preferred materials for the manufacture of such blocks are injection moldable high strength thermoplastics such as polyvinylchloride, or fiberglass and resin compositions. Recycled plastics and composites including recycled plastics are also suitable. Materials such as molded ferrocement and other composite materials may also be used.

The first embodiment of the invention further includes lugs 34 and sockets 36 (see FIG. 2) on the base of each block which cooperate with a cover plate or an adjacent block as shall become apparent hereinafter. The lugs 34 are preferably truncated rectangular pyramids through circular or hexagonal cylinders or any other convenient shape may be employed. The rectangular truncated pyramid shape is preferred because it is easily registered with complementary sockets 36.

Figure 4:
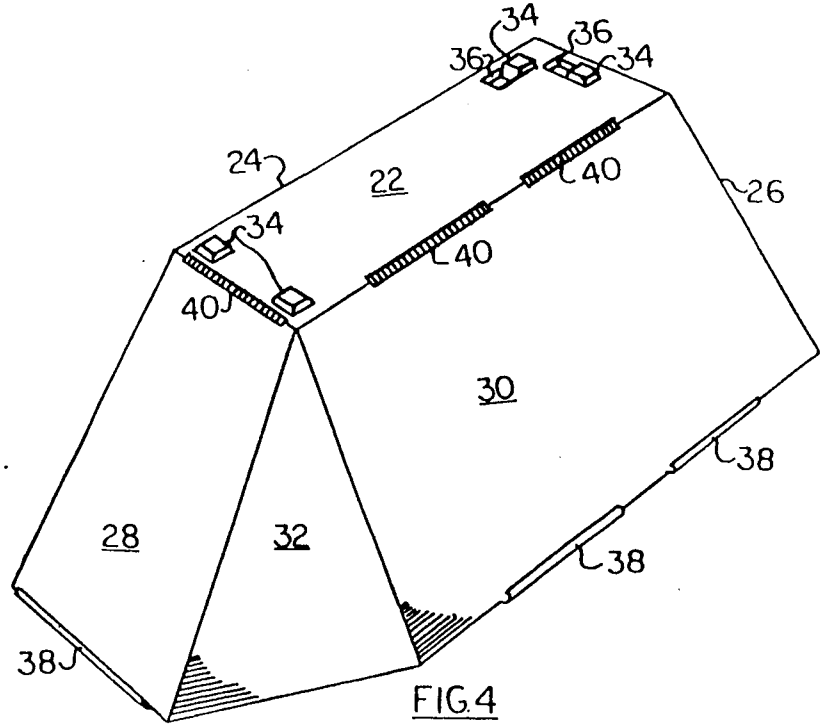
FIG. 4 is a perspective view of the building block shown in FIG. 3.
Figure 3:
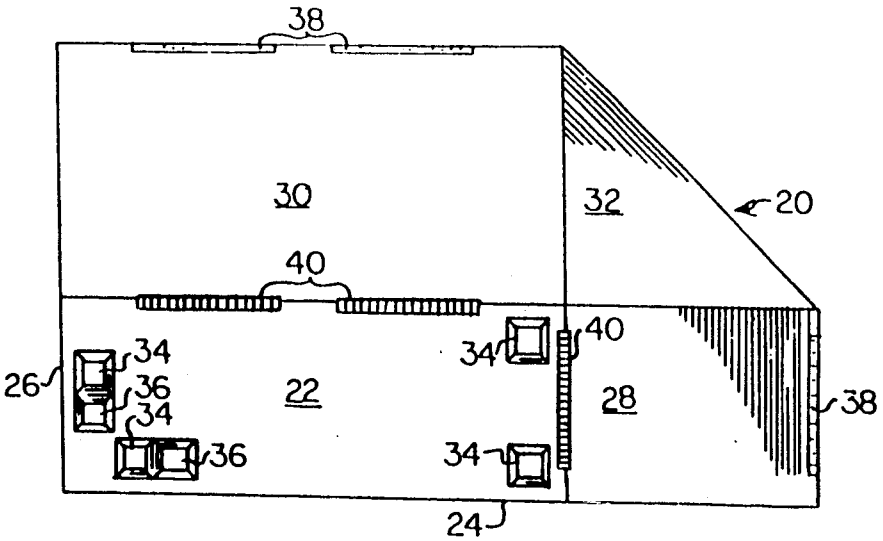
FIG. 3 is a bottom plan view of another embodiment of a building block in accordance with the invention.

FIGS. 3 and 4 illustrate an alternate embodiment of the invention shown in FIGS. 1 and 2. This embodiment includes integrally molded hook members 38 which are formed along the top edges of side walls 28 and 30 respectively. Further included are notches or recesses 40 formed in the respective edges of bottom wall 22. Hook members 38 and notches 40 permit the interlocking of the blocks into four block units as will become apparent in the description of FIG. 10 and 11.

Figure 5:
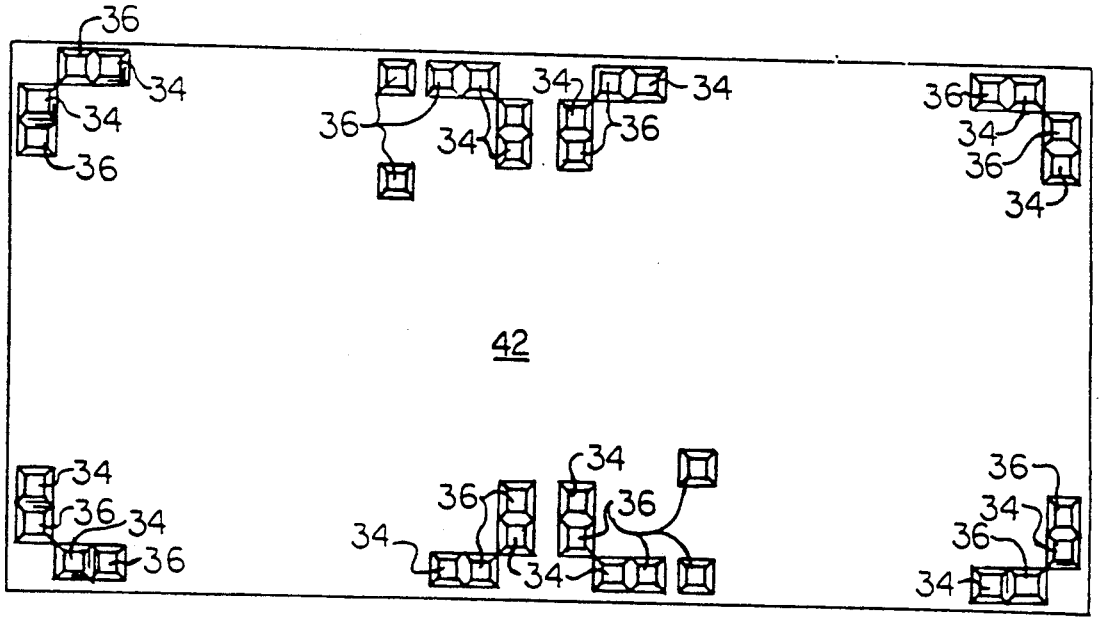
FIG. 5 which appears on page 4 of the drawings, is a plan view of a cover plate for building blocks in accordance with the invention, the opposite side of the cover plate being a mirror image of the side illustrated.

FIG. 5 shows a cover plate 42 used in conjunction with the building blocks illustrated in FIGS. 1–4. As is apparent, cover plate 42 is provided with strategically located lugs 34 and sockets 36 which cooperate with complementary lugs 34 and sockets 36 on the bases of the building blocks shown in FIGS. 1–4. The lugs 34 also cooperate with the top edges of the blocks for interlocking four blocks which are arranged in a double wide, double long configuration of a rectangular solid as will be explained in more detail hereinafter.

Figure 7A:
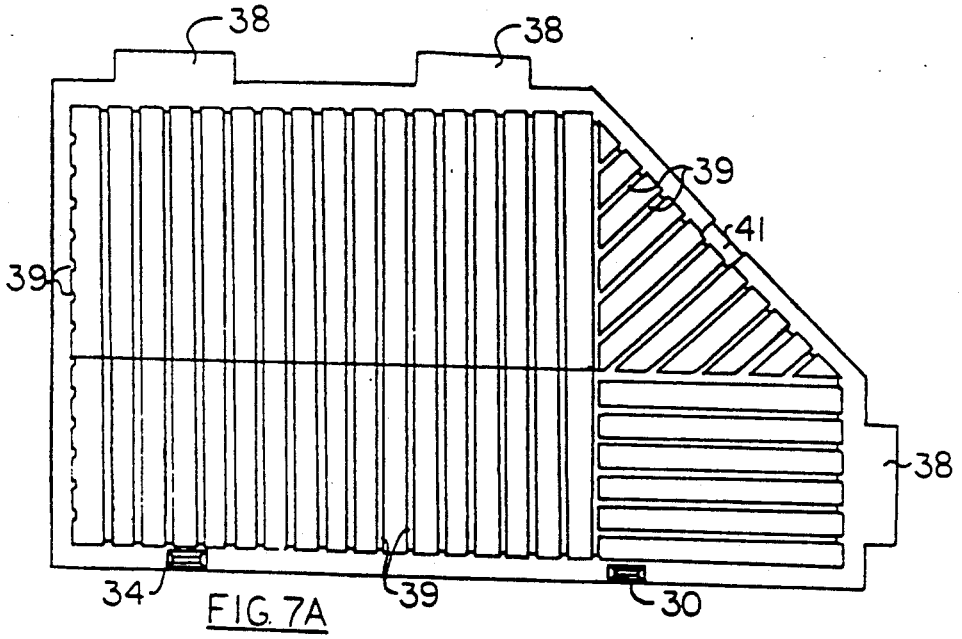
FIG. 7A is a top plan view of the block shown in FIG. 7 further including reinforcing ribs on the inside walls of the block.
Figure 7:
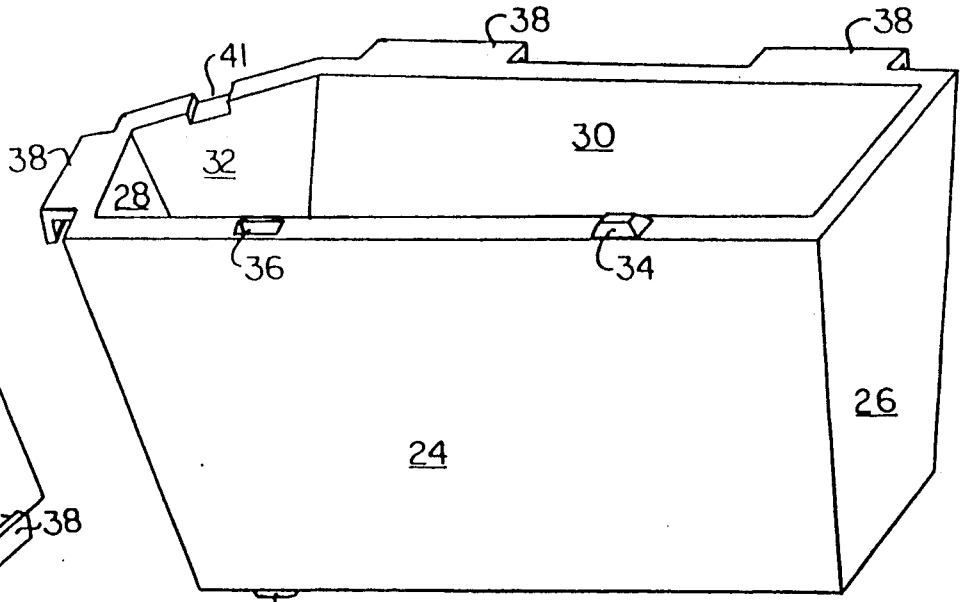
FIG. 7 is a perspective view of the opposite end and the top side of the block shown in FIG. 6.
Figure 6:
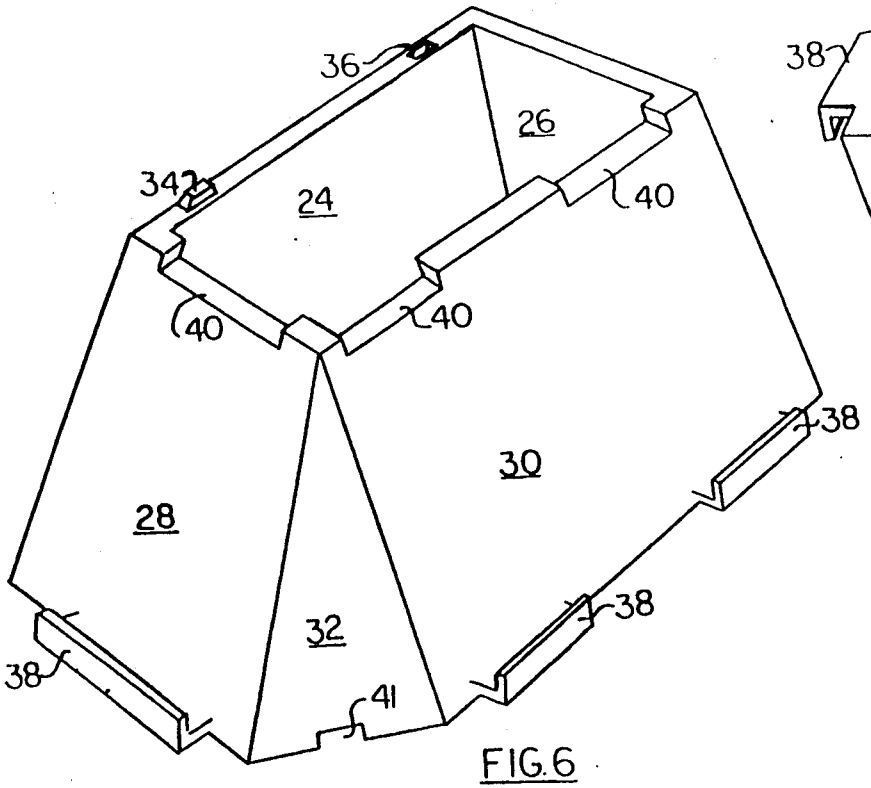
FIG. 6 is a perspective view from above and one end and of the bottom side of a further embodiment of a building block in accordance with the invention.

FIGS. 6 & 7 show a further embodiment of the blocks 20 in accordance with the invention. In accordance with this embodiment, the side walls 24, 26, 28, 30 and 32 are thicker and the two vertical side walls 24 and 26 include integral lugs 34 and sockets 36. This permits the blocks to be assembled into vertical walls structures without the use of cover plates 42, further simplifying the number of components required in a building. This embodiment of the block may not have a bottom wall (See FIG. 6) or, alternatively, a bottom wall (not illustrated) may be provided. The advantage of eliminating the bottom wall of the block is that fine granular fill such as sand or dry earth poured into the top course of an assembled wall will fill substantially the entire wall, eliminating the need for filing each course of blocks as they are laid. The disadvantage of not having a bottom wall include the facts that settling may occur in the wall so that the top courses become void, and that filler materials which have a liquid phase such as water, ice or snow cannot be used.

As shown in FIG. 7A the inside walls of the block are advantageously provided with ribs or corrugations 39 for reinforcing the block in a manner well known in the art. The cross-sectional dimensions of corrugations 39 are dependent on the strength required. Corrugations 39 also help prevent stacked blocks from sticking together and thereby facilitate the handling of stacked blocks.

Figure 8A:
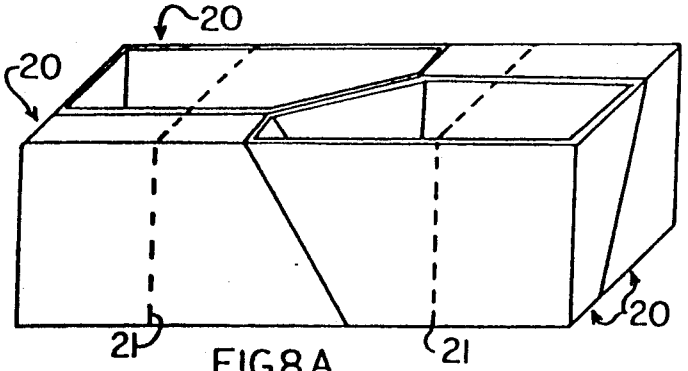
FIG. 8A which appears on page 6 of the drawings, is a diagram illustrating the derivation of half block units in accordance with the invention.
Figure 8B:
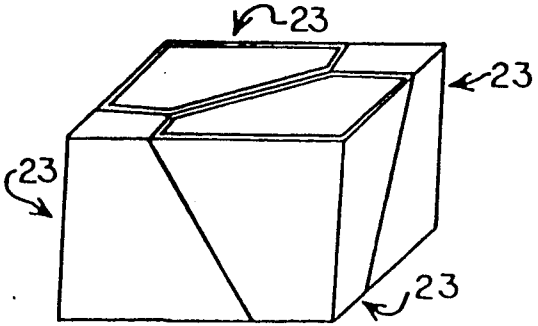
FIG. 8B which also appears on page 6 of the drawings, is a diagram of four half blocks in accordance with the invention, assembled to form a half unit required at window openings and at the ends of alternate wall courses.

FIGS. 8A and 8B illustrate the derivation of half block units, required for accommodating window and door openings as well as for finishing certain corner and free standing wall constructions. FIG. 8A shows four blocks 20 arranged in a standard configuration. The dotted lines 21 show the points where end walls are placed in order to form appropriate half blocks 23 (see FIG. 8B and FIG. 13). In all other respects, half-blocks 23, shown in a plain generic style without lugs 34, sockets 36 or hooks 38, are constructed in exact accordance with the embodiments shown in FIGS. 1-7. A half cover plate (not illustrated) may also be required in certain constructions, in which case it is constructed in accordance with the same principle; i.e. a half cover plate is made in accordance with the center portion of the cover pate 42 (see FIG. 5), one quarter of the length of the plate being removed from each its ends.

FIG. 9 illustrates a starter wall course assembled from building blocks shown in FIGS. 1-4. The starter wall course may be placed on any level firm footing 44. The footing 44 may include a concrete footer, a crushed stone dam or a firm level earth surface. The footer 44 is preferably covered with a foam or fiberglass sill sealer 46, widely available and known in the art, before the first wall course is laid. Cover plates 42 are placed in end to end abutment along the length of the wall. Building blocks 20 are then arranged in double wide, double long, end to end relationship as illustrated to form a wall course having vertical parallel inside and outside surfaces. As is apparent, building blocks 20 are alternately positioned in an open side down, open side up relationship. When the course is completed, the blocks having their open sides up are preferably filled with some locally available material to lend weight to the wall. Any readily available material may be used including gravel, crushed stone, earth, slag, water, ice or snow. Cover plates 42 are then placed on top of the first course of blocks 20 and a second course is added to the wall structure. It should also be noted that corners of the structure may interlock as will be explained in more detail in relation to FIG. 11.

FIG. 10 is a schematic of the interlocking of blocks 20 shown in FIGS. 6 and 7. As is apparent, blocks 20 in accordance with this embodiment are laid into wall structures without the use of cover plates 42. Each block interlocks vertically with a block below or above it by the intermeshing of lugs 34 with complementary sockets 36, and vice versa. The blocks are interlocked laterally and longitudinally (within each four block unit) by the interconnection of hooks 38 and hook recesses 40 (See FIG. 6). A further socket 41 in the top of the inclined triangular side wall receives a lug 34 which is positioned on the top edge of the vertical end wall. Buildings may be constructed with this embodiment of the block using only two types of units, the block shown in FIGS. 6 and 7 and half block units constructed in the same manner by the principle explained in relation to FIGS. 8A and 8B.

Figure 11:
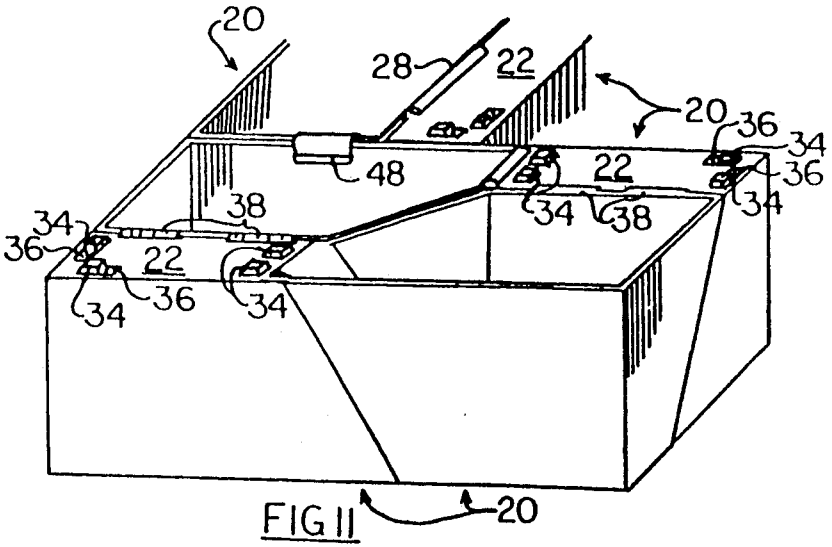
FIG. 11 is an illustration of four of the blocks shown in FIGS. 3 and 4 assembled in a rectangular unit, and further illustrates one method for clipping each four block unit to an adjacent unit.

FIG. 11 shows a simple assembly of the blocks illustrated in FIGS. 3 and 4. As is readily apparent, the hook members 38 engage hook recesses 40 (see FIGS. 3 and 4) in the rectangular bases 22 of blocks 20. Thus, each four block unit is interlocked by both hook members 38 and the cover plates 42 (see FIG. 9). The four interlocking block units may be likewise interconnected by spring clips 48 which clip over the open end edges of two adjacent blocks. This connection may be made at the corners of a wall as illustrated and at the opposite ends of each four block unit. Thus, in areas prone to earthquake or other environmental stresses where an exceptionally resilient and wrack resistant structure is required, all blocks in a structure may be positively interlocked to inhibit collapse of the structure under even severe racking forces. This interlocking method may be applied with equal success to the embodiments of blocks shown in FIGS. 1 and 2 as well as those shown in FIGS. 6 and 7.

Figure 12:
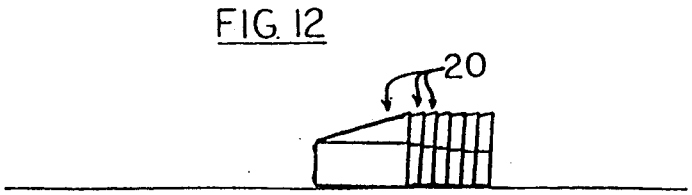
FIG. 12 is an illustration of building blocks in accordance with the invention in a stack condition ready for storage or shipment.

As may be seen in FIG. 12, building blocks 20 in accordance with the invention are stackable for convenient storage and transport. The ratio of space occupied by stacked blocks compared with the space occupied by blocks assembled into a wall structure is approximately one to five. Thus, considerable economy of storage space and transportation volume is achieved with blocks in accordance with the invention. The cover plates 34 are likewise stackable and form rectangular columns (not illustrated) that are extremely stable when stacked.

Figure 13:
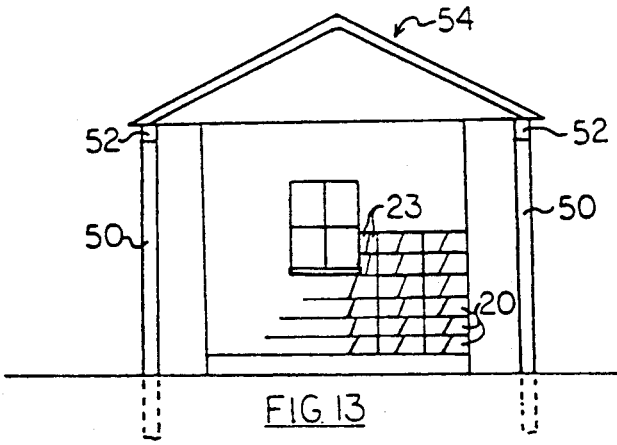
FIG. 13 illustrates one method of attaching a typical roof structure to a building assembled with building blocks in accordance with the invention.

FIG. 13 illustrates one method of attaching a tradional truss-type roof structure to a building constructed in accordance with the invention. The roof structure, generally indicated by reference 54 is supported on longitudinal beams 52 which are in turn supported on vertical posts 50. Although the roof structure rests on the top of the building walls, there are no direct ties between the building structure and the roof structure.

Figure 14:
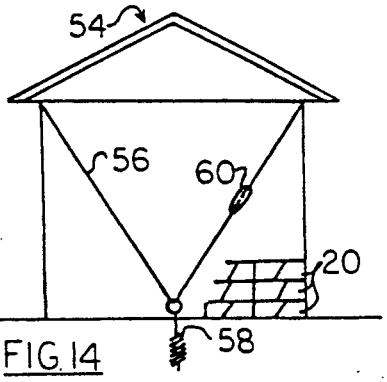
FIG. 14 illustrates an alternate method of attaching a typical roof structure to a building assembled with blocks in accordance with the invention.

FIG. 14 illustrates an alternate method of attaching a truss-type roof structure to a building constructed from blocks in accordance with the invention. The roof structure 54 is supported on the exterior walls of the building and anchored at each end by a steel or nylon cable 56 which passes through an eye affixed to the shaft of an earth auger 58, commonly used for anchoring guy wires and the like. The cable 56 is tensioned by a turnbuckle 60, to secure the roof structure firmly to the building.

Figure 15:
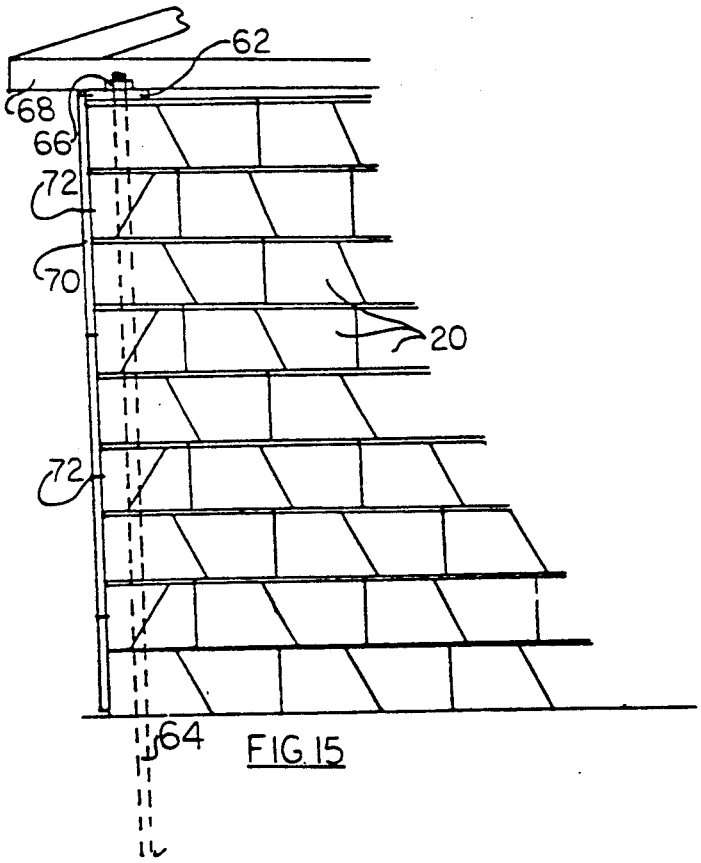
FIG. 15 illustrates two further methods of attaching a roof structure to a building assembled with blocks in accordance with the invention.

FIG. 15 illustrates two further methods of attaching a roof structure to a building constructed with the blocks heretofore described. In accordance with a first method, a top wall plate 62 is anchored to the building structure at each corner by an elongated rod 64 having a threaded top end. The rod 64 passes through holes drilled through the bottom walls of the building blocks 20. The rod 64 is driven into the ground surface below the building structure or set in a cement footing under the structure. A nut and washer 66 secure a wall top plate 62 to the building structure. Roofing trusses 68 are then nailed to the wall top plate 62 in the usual manner well known in the art. Alternatively, the wall top plate 62 may be secured to the building blocks 20 by batten boards 70 (typically softwood 1×4's) which are attached tot he building blocks 20 with screw fasteners 72. Assuming the building blocks 20 are manufactured from moldable thermoplastic such as PVC or fiberglass and plastic resin compositions, screw fasteners are quite effective in attaching batten boards 70 to the surface of the building structure. When affixed to the structure at regular intervals, batten boards 70 may also be used to support an exterior finish such as aluminum or PVC siding and the like.

Changes and modifications in the specifically described embodiments can be carried out without departing from the scope of the invention which is intended to be limited only by the scope of the appended claims.

I claim:

1. A hollow stackable building block having side walls with parallel spaced-apart top and bottom edges which respectively define the perimeters of a base plane and a top plane of the block, wherein the base plane of the block is rectangular and the top plane of the block is pentagonal, the side walls of the block comprising:

a trapezoidal side wall which is perpendicular to the base plane of the block, having a square end and an opposite end which is inclined away from the square end at an obtuse angle with respect to the bottom edge of said side wall;

a trapezoidal end wall which is perpendicular to the base plane and continuous on one end with the square end of the trapezoidal side walls, an opposite end being inclined away from the one end at an obtuse angle with respect to the bottom edge of the end wall;

a rectangular side wall which is continuous with the inclined end of the trapezoidal side wall and thereby inclined at an angle with respect to the base plane of the block;

a rectangular end wall which is continuous with the inclined end of the trapezoidal side wall and thereby inclined at an angle with respect tot he base plane of the block; and a triangular side wall disposed between and respectively continuous with the adjacent ends of the rectangular side wall and the rectangular end wall.

2. A hollow stackable building block as recited in claim 1 wherein the block includes a bottom wall.

3. A hollow stackable building block as recited in claim 1 wherein the top and bottom edges of the block include projecting lugs and complementary sockets which are located so that the blocks interlock when stacked one on top of another in a predetermined arrangement.

4. A hollow stackable building block as recited in claim 2 wherein the bottom wall of the block is provided with projecting lugs and complementary sockets which are located to interlock with correspondingly sized projecting lugs and sockets provided on the opposed faces of a thin rectangular plate for interlocking a predetermined number of blocks together to form a construction unit.

5. A hollow stackable building block as recited in claims 1 or 2 wherein the top edge of at least one of the side and end walls include hook shaped appendages which extend beyond an outer periphery of said edge of the block for lockingly engaging an edge of another block located in an adjacent relationship in the wall structure.

6. A hollow stackable building block as recited in claims 1 or 2 further including corrugations on the inside surface of the block for reinforcing the strength of the block.

7. A hollow stackable building block as recited in claim 3 further including corrugations on the inside surface of the block for reinforcing the strength of the block.

8. A set of hollow stackable building blocks for constructing vertical parallel-sided wall structures, said set including a full block of a given width and a given length, and a half block of the given width and one half the given length of the full block, the full block and the half block each having side walls with spaced-apart top and bottom edges which respectively define the perimeters of a base plane and a top plane of each block, the side walls of each block comprising:

a trapezoidal side wall which is perpendicular to the base plane of the block, having a square end and an opposite end which is inclined away from the square end at an obtuse angle with respect to the bottom edge of said side wall;

a trapezoidal end wall which is perpendicular to the base plane and continuous on one end with the square end of the trapezoidal side wall, an opposite end being inclined away from the one end at an obtuse angle with respect to the bottom edge of the end wall;

a rectangular side wall which is continuous with the inclined end of the trapezoidal side wall and thereby inclined at an angle with respect to the base plane of the block;

a rectangular end wall which is continuous with the inclined end of the trapezoidal side wall and thereby inclined at an angle with respect to the base plane of the block; and a triangular side wall disposed between and respectively continuous with the adjacent ends of the rectangular side wall and the rectangular end wall.

9. A set of hollow stackable building blocks as recited in claim 8 wherein each block in the set includes a bottom wall.

10. A set of hollow stackable building blocks as recited in claim 8 wherein the top and bottom edges of each block includes projecting lugs and complementary sockets which are located so that the blocks of the set interlock when stacked one on top of another in a predetermined arrangement.

11. A set of hollow stackable building blocks as recited in claim 8 wherein the bottom wall of each block of the set is provided with projecting lugs and complementary sockets which are located to interlock with correspondingly sized projecting lugs and sockets provided on the opposed faces of a thin rectangular plate for interlocking a predetermined number of blocks together to form a construction unit.

12. A set of hollow stackable building blocks as recited in claim 8 wherein the top edge of at least one of the side and end walls of each block in the set includes hook shaped appendages which extend beyond an outer periphery of said edge of the blocks in the set for lockingly engaging an edge of another block located in an adjacent relationship in the wall structure.

13. A set of hollow stackable building blocks as recited in claim 8 wherein each block in the set further includes corrugations on the inside surfaces of the block for reinforcing the strength of the block.

* * * * *

UNITED STATES PATENT AND TRADEMARK OFFICE

CERTIFICATE OF CORRECTION

PATENT NO. : 5,107,653

DATED : April 28, 1992

INVENTOR(S) : John F. Lewis

It is certified that error appears in the above-identified patent and that said Letters Patent is hereby corrected as shown below:

Col. 7, line 12, Claim 1, delete "walls" and substitute therefor ---wall---; Col. 7, line 22, Claim 1, delete "tot he" and substitute therefor ---to the---.

Signed and Sealed this

Thirty-first Day of August, 1993

*Attest:*

Bruce Lehman

BRUCE LEHMAN

*Attesting Officer*

*Commissioner of Patents and Trademarks*